US005603640A

United States Patent [19]

Mouissie

[11] Patent Number: 5,603,640

[45] Date of Patent: Feb. 18, 1997

[54] PLANAR FILTER FOR A MULTI-POLE PLUG CONNECTOR AND PLUG CONNECTOR USING THE PLANAR FILTER

[75] Inventor: Bob Mouissie, Berlicum, Netherlands

[73] Assignee: Filtec, Filtertechnologie fuer die Elektronikindustrie GmbH, Lippstadt, Germany

[21] Appl. No.: 353,613

[22] Filed: Dec. 12, 1994

[30] Foreign Application Priority Data

Dec. 11, 1993 [DE] Germany ..... 43 42 326.4

[51] Int. Cl.[6] ..... H01R 13/66

[52] U.S. Cl. ..... 439/620

[58] Field of Search ..... 439/608, 620

[56] References Cited

U.S. PATENT DOCUMENTS

| | | | |
|---|---|---|---|
| 4,853,659 | 8/1989 | Kling | 439/620 |
| 4,959,626 | 9/1990 | Mouissie | 439/620 |
| 5,153,540 | 10/1992 | Gliha, Jr. | 439/620 |
| 5,164,873 | 11/1992 | Krantz et al. | 439/620 |
| 5,213,524 | 5/1993 | Okamoto et al. | 439/620 |
| 5,236,376 | 8/1993 | Cohen | 439/620 |
| 5,242,318 | 9/1993 | Plass | 439/620 |
| 5,364,293 | 11/1994 | Peterson | 439/620 |
| 5,387,131 | 2/1995 | Foreman et al. | 439/620 |
| 5,409,401 | 4/1995 | Schaorschmidt | 439/620 |

*Primary Examiner*—P. Austin Bradley
*Assistant Examiner*—Jill Demello
*Attorney, Agent, or Firm*—Herbert L. Lerner; Laurence A. Greenberg

[57] ABSTRACT

A plug connector has a conducting metal housing and a plurality of signal lines in the form of connection pins disposed in rows and columns. A planar filter assembly includes a planar filter having a ground electrode and two opposed edges constructed as conductive side regions being connected to the ground electrode and being connected to ground through the housing. A substrate has openings formed therein each receiving a respective one of the connection pins. Capacitors are each disposed in the vicinity of a respective one of the openings for a respective one of the connection pins. Each of the capacitors has a first coating being connected to a respective one of the connection pins and being extended into a respective one of the openings, a second coating connected through the housing to ground, and a layer-like dielectric disposed between the first and second coatings. Contact inserts are each soldered in a respective one of the openings for retaining a respective one of the connection pins and each have at least two contact prongs electrically connecting a respective one of the connection pins to the first coating of a respective one of the capacitors.

14 Claims, 6 Drawing Sheets

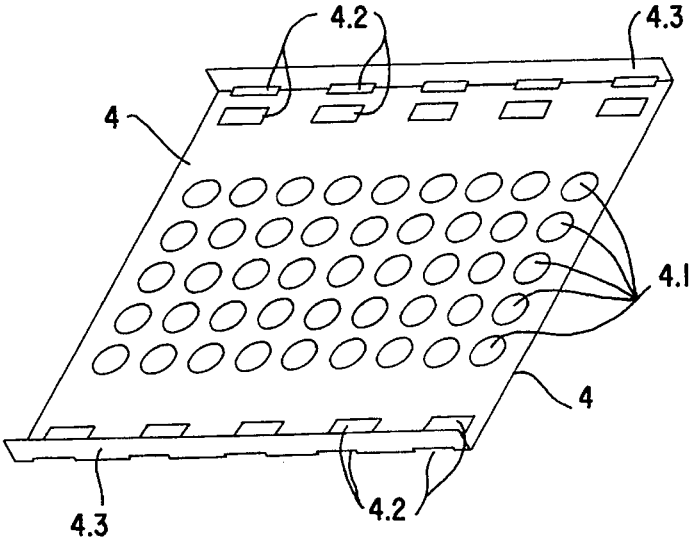
Fig.3
Fig.4
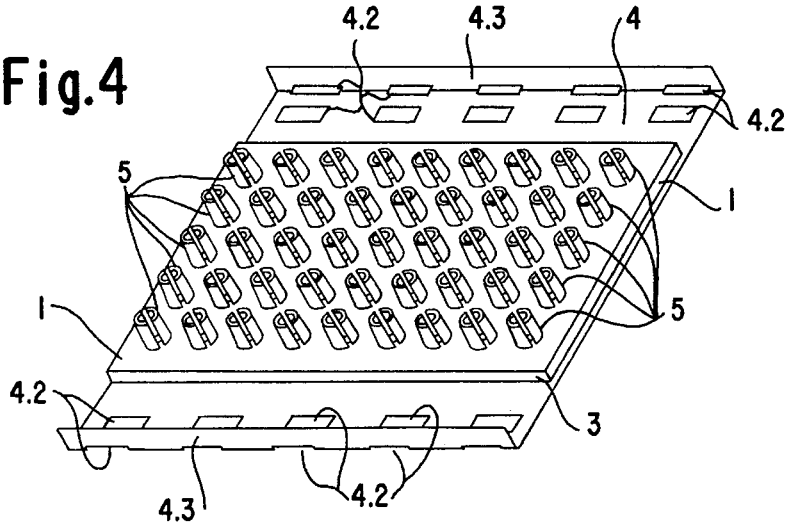
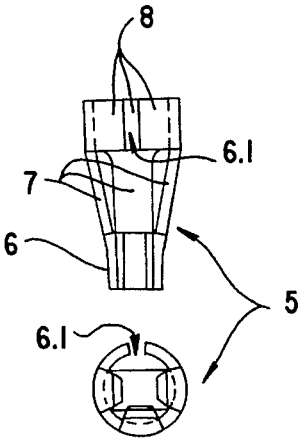
Fig.6
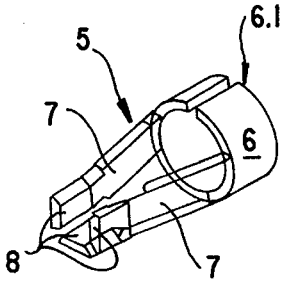
Fig.5

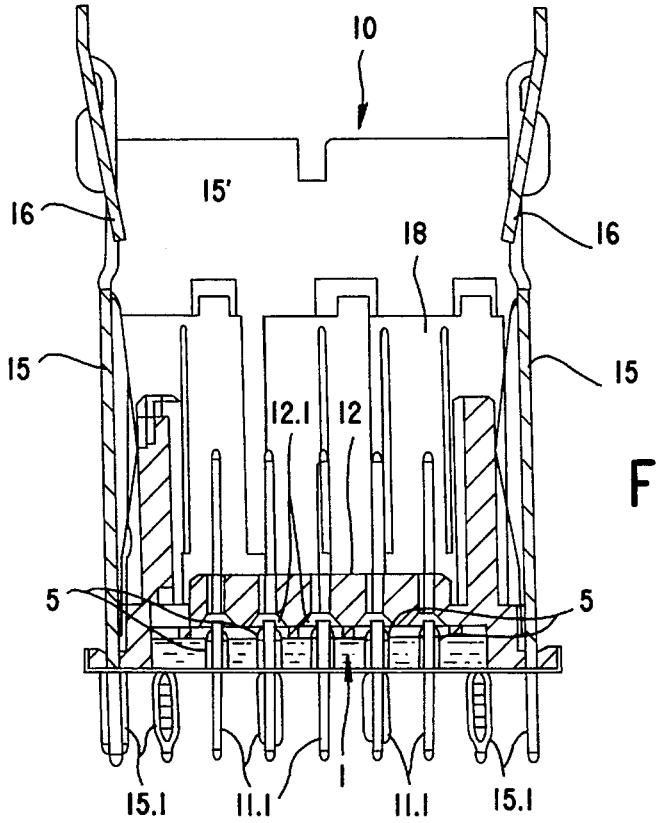
Fig.9a
Fig.9b
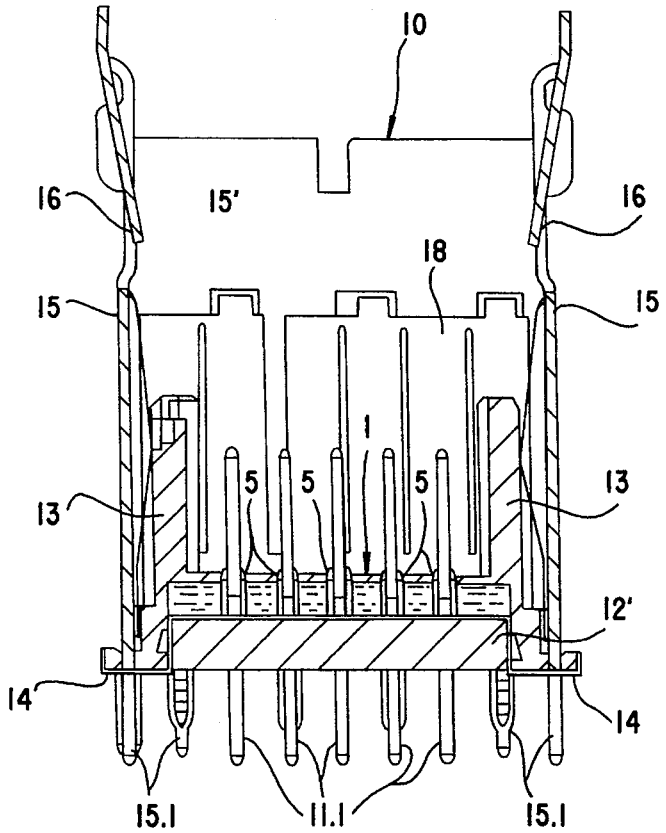

PLANAR FILTER FOR A MULTI-POLE PLUG CONNECTOR AND PLUG CONNECTOR USING THE PLANAR FILTER

BACKGROUND OF THE INVENTION

FIELD OF THE INVENTION

The invention relates to a planar filter for plug connectors, having a plurality of connectible signal lines disposed in rows and columns, a substrate having an opening for each of the signal lines and having a capacitor in the vicinity of the opening for each of the signal lines, each capacitor having a first coating connected to an associated signal line, a second coating connected to ground through a conducting housing, and a layer-like dielectric between the first and second coatings. The invention also relates to a plug connector being intended especially for mounting on printed wiring boards and using the planar filter.

Such multipole plug connectors are used for transmitting digital or analog measurement signals from multiple measuring instruments or for high-speed transmission of information, in order to filter out interference signals. Such a filtering out of interference signals is generally done with capacitors, one of which is provided for each line carrying a signal. To that end, the capacitors are advantageously combined into planar filters and inserted into the plug connectors, and the planar filters are penetrated by the signal lines. For each of the signal lines, at least one capacitor is provided, and the capacitors are disposed on a generally ceramic and in particular aluminum oxide substrate. If the individual signal lines are constructed as pins (press-fit connection) pressed into plastic parts, then there is no way to solder those pins to the coatings of the signal electrodes which extend into the leadthrough. Plug connectors of that kind are described, for instance, in U.S. Pat. No. 3,447,104, U.S. Pat. No. 4,741,710, or Published European Application No. 0 398 807 A2, corresponding to U.S. Pat. No. 4,950,185. In order to make a filter plug connector, planar filters and seals are inserted into the connector housing. The various capacitors of the planar filter are connected to the connector housing for producing the ground connection through grounding springs that engage the outer edge of the planar filter, and are connected to the connection pins inserted into the leadthrough openings through spring clamps for the contact prongs, in order to produce the signal line branches. Moreover, it is difficult to accommodate the capacitors, which are required for effective filtering, on the substrate of the planar filter, since in the known configurations each filter capacitor surrounds the associated signal line. Additionally, there is an annular surface in the immediate vicinity of the signal line. In that surface the ground coating, which is not extended all the way up to the signal line because of the necessary insulation, is missing, and therefore the surface cannot contribute to the capacitance. The goal of that construction is to achieve adequate filtering with closely spaced signal lines, with the filtering also being damped by mechanical jarring. In those configurations it is disadvantageous that from the very outset they have to be mounted with the plug connectors, so that the connection of the signal line to the associated capacitor coating is soldered. However, that kind of soldered connection is not possible if the signal line is constructed as pins that are press-fitted into a plastic plate.

SUMMARY OF THE INVENTION

It is accordingly an object of the invention to provide a planar filter for a multi-pole plug connector and a plug connector using the planar filter, which overcome the hereinafore-mentioned disadvantages of the heretofore-known devices of this general type, in which which the planar filter can furnish adequate capacitances, with closely spaced signal lines, for various capacitors surrounding the signal lines and which can be inserted into the plug connectors without soldered connections, in such a way that it can be connected to connection pins that are press-fitted into plastic parts and can also be inserted into already-existing plug connections that are provided with a plug connector.

With the foregoing and other objects in view there is provided, in accordance with the invention, in a plug connector having a conducting metal housing and a plurality of signal lines in the form of connection pins disposed in rows and columns, a planar filter assembly comprising a planar filter having a ground electrode and two opposed edges constructed as conductive side regions being connected to the ground electrode and being connected to ground through the housing; a substrate having openings formed therein each receiving a respective one of the connection pins; capacitors each being disposed in the vicinity of a respective one of the openings for a respective one of the connection pins, each of the capacitors having a first coating being connected to a respective one of the connection pins and being extended into a respective one of the openings, a second coating connected through the housing to ground, and a layer-like dielectric disposed between the first and second coatings; and contact inserts each being soldered in a respective one of the openings for retaining a respective one of the connection pins and each having at least two contact prongs electrically connecting a respective one of the connection pins to the first coating of a respective one of the capacitors.

According to the invention, one contact insert with at least two contact prongs is soldered into each of the openings of the planar filter and thus fixed in the opening. As a result of this soldering, it is electrically connected to the first coating of the associated capacitor which extends into the opening, and through the contact prongs it is connectable to the first coating of the capacitors that is associated with the respective signal electrode. With these contact prongs, the connection pin of the plug connector, extended through the insert, is both retained and electrically connected to the associated coating of the signal electrode of the capacitor. Two opposed edges of the planar filter are constructed as conductive side regions connected to its ground electrode and they are connected to ground in general through the metal housing of the plug connector. As a result of this configuration, by soldering, contact inserts that are firmly anchored in the planar filter are used in order to retain the through-extending connection pins resiliently. The same applies to the ground connection, which is a firm connection to the side regions of the planar filter.

The capacitors are limited in size by the space between the signal lines. If the leadthrough density is tight, then adequate capacitances can be attained only with dielectrics of extraordinarily high dielectric constants, yet such dielectrics are difficult to process. In order to limit the capacitances, the leadthrough of the connection pins plays a significant role. To prevent voltage sparkovers, the continuous ground electrode ends at some distance before the leadthrough opening for the connection pin. This creates an annular region that contributes nothing to the capacitance and that becomes especially important with disk-shaped electrodes.

In accordance with another feature of the invention, the first coatings of the capacitors, which are associated with the signal electrodes, are then constructed in such a way that they have a double dumbbell-like or diabolo-like structure with a preferential axis and are internested in one another in such a way that the preferential axes of adjacent capacitors extend crossing one another, and then the surface area covered is (relatively) increased with no change in the space requirement, and thus the capacitances of the capacitors are increased as well. Since the influence of inductance and transit time must already be taken into account at the frequencies which are important in that case, it is not always possible to use all of the available space.

In accordance with a further feature of the invention, the structures are constructed as a double T, with the preferential axis formed in the middle of the middle beam that joins the two end pieces, in the middle of which the leadthrough for the associated connection pin is disposed.

In accordance with an added feature of the invention, in order to enable soldering of the contact insert into the leadthrough openings, each contact insert has a sheath that is constructed as a soldering sheath which is insertable, for instance in form-locking fashion, into the opening for the leadthrough of the connection pins, and by soldering is solderable and electrically connectable to the first coating of the capacitor associated with the signal electrode, which coating extends into this opening. A form-locking connection is one which connects two elements together due to the shape of the elements themselves, as opposed to a force-locking connection, which locks the elements together by force external to the elements. As a result of these features, an insert that can be inserted into each of the openings is created. The electrical connection with the coating of the signal electrode is made by this soldering sheath, having an outside diameter which is approximately equivalent to the inside diameter of the opening. The soldering sheath in one embodiment is soldered in the opening to the capacitor coating that extends into the opening and leads to the signal electrode. Taking jarring into account, the result is a secure mechanical retention of the connection pins in the opening and their proper electrical connection with the coating with the associated capacitor. The inserts provided for each connection pin leadthrough are components of the planar filter and they are advantageously rolled from a spring-elastic metal material, especially spring bronze, which may be provided with a noble metal overlay to improve contact making, and are inserted into the leadthrough openings of the planar filter in such a way that the connection pins of the plug connector are plugged through the contact inserts and clamped there. This way of achieving filtering is especially suitable for plug connectors in which the connection pins are press-fitted into a plastic substrate and, for instance, fixed in the plastic with harpoon-bar-like anchors, because of the temperature strain during soldering. The clamping produces a good seat and good contact making, so that this embodiment is usable at least whenever a limited temperature-bearing capacity does not allow soldering. The same is true for the case where absolute dimensional accuracy does not exist, since the resilient contact inserts have a certain give. These characteristics also allow plug connectors to be retroactively equipped with thus-constructed planar filters. Through the use of these resilient contact inserts, the force path from the pin to the filter substrate is also interrupted, which affords greater security against forces that occur in the presence of major acceleration or deceleration.

Due to the resilient contact prongs, soldering to the connection pins becomes unnecessary and they do not hinder use due to dimensional deviations. The resilient contact inserts also establish perfect electrical contact between the connection pins and the associated coatings of the capacitors, so that neither factor is any hindrance to retrofitting. The sheaths can be soldered into the leadthrough openings, since the planar filter can withstand thermal loads and in that stage of manufacture is still separate from the plug connector that is to be equipped. Despite this soldering of the contact insert into the leadthrough opening of the filter substrate, the advantages are preserved, since contact prongs that cooperate with the pins remain unimpaired.

Advantageously, each of the contact inserts has a sheath, from which contact prongs that taper conically extend in an essentially axial direction. As a result of this embodiment, good form-locking in the cylindrical leadthrough opening in the substrate of the planar filter is attained, for one thing. The axially extending contact prongs also form a narrowing cone-like structure, through which the connection pin is guided, that clamps into this structure and thus gains a secure seat. The sharp edges of the material also establish a secure electrical contact.

In accordance with an additional feature of the invention, the contact insert, especially for clamping flat-type connection pins, have two contact prongs that cooperate with the connection pin and that are disposed facing one another. The connection pin cooperates with these opposed contact prongs in such a way that it forces them apart and is held firmly by clamping, with the clamping forces establishing the contact.

In accordance with yet another feature of the invention, especially for clamping round connection pins, three contact prongs are provided, which have an angular spacing of 90° or 120° with respect to the circumferential angle of the sheath. The contact insert having the three contact prongs thus has an embodiment that can still be mechanically accomplished even at the small size of such contact inserts. The contact prongs may be distributed uniformly over the circumference of the sheath, which leads to an annular spacing of 120°. The contact prongs clamp to pins of round diameter as well as to pins of other cross-sectional shapes, and optionally the disposition of contact prongs is adapted to the cross section of the pins. At an angular spacing of 90°, the contact prongs are not distributed uniformly over the circumference. Instead, a gap forms, so that unilateral pressure is exerted on the connection pin.

In accordance with yet a further feature of the invention, the sheath is provided with an axial gap that on one hand is disposed centrally between two contact pins or on the other hand is disposed in such a way that two adjacent contact prongs are angularly spaced apart from it by 90°, with the third contact prong disposed diametrically opposite that gap. Due to this gap, which is advantageously provided centrally between two of the contact prongs, the sheath gains the resilient clamping action that facilitates the introduction of the sheath into the leadthrough opening.

In order to produce this kind of contact insert, a strip of a resilient-elastic material, for instance spring bronze provided with a noble metal coating, is stamped and rolled in such a way that the sheath with the contact prongs is retained by a strip of a metal band. The spacing of the sheaths is equivalent to the spacing of the regularly spaced successive leadthrough openings for the connection pins, their number is equivalent to the number of these leadthrough openings, and the remaining strip of a band forms an aid in transporting them. The contact inserts remain on the band strip, which is cut apart into segments, each having the required number of contact inserts. They are inserted into the planar filter, retained in this way, and separated from the band strip afterward. Production is effected in such a way that an endless strip can be processed, and the contact inserts are produced in groups.

In accordance with yet an added feature of the invention, the planar filter, which is equipped with such contact inserts, is disposed on a metal ground contact plate, which has openings that correspond to the leadthrough openings of the ceramic filter substrate and have a larger diameter so as to prevent undesired contact between the connection pins and the ground contact plate that is connected to ground potential. At least on one of the sides and preferably on two opposed sides of the planar filter, the ground contact plate has a strip-like projection, for connection to the contacts connected to ground or to ground in general. The ground connection is preferably effected through the plug connector.

In accordance with yet an additional feature of the invention, the protruding peripheral strip or strips of the metal substrate is provided with aligned openings, for the leadthrough of the securing prongs of the baffles of the lateral shields, which are moreover connected to ground. With this embodiment, it is achieved that the thus-equipped planar filter can be inserted into the plug connector without difficulty, by purely mechanical steps.

With the objects of the invention in view, there is also provided a plug connector to be mounted on a printing wiring board, comprising signal lines in the form of connection pins; a planar filter having a substrate with openings formed therein each receiving a respective one of the connection pins, the planar filter having capacitors, and the planar filter having contact inserts clamping and making contact with the connection pins; lateral shielding baffles having securing and contact prongs; a plastic base plate having a side facing toward a printed wiring board, the side having a recess formed therein receiving the planar filter, the base plate having openings formed therein widening conically toward the recess for leading the connection pins through, and the base plate having openings formed therein for leading the securing and contact prongs through for connecting the securing and contact prongs to general ground; lateral guide prongs extending at right angles to the base plate and being formed onto the base plate for engaging and guiding counterpart plugs, with the connection pins meeting and being introduced into bushes, the lateral guide prongs being disposed in segments having interruptions therebetween; transverse shields being inserted in the interruptions between at least some of the segments; and a ground contact plate to which the planar filter is fixed and conductively connected, the ground contact plate having strip-like projections clamping and making contact with the securing and contact prongs of the lateral shielding baffles for electrically connecting the planar filter through to the connection pins and to ground with the capacitors acting as capacitances between the connection pins and ground.

Thus the planar filter can be disposed under the base plate, and possibly projecting parts of the contact prongs find space in the conical widenings of the base plate, and the ground contact plate, on which the planar filter is mounted and which together with the shielding baffle inserts of the lateral shields and the transverse shields are affixed to the base plate, provide effective shielding from the underside.

It is advantageous if the projecting peripheral strip or strips of the ground contact plate are provided with openings, which are aligned with the lateral shields for the leadthrough of the securing prongs of lateral shields and with corresponding holes in the printed wiring board. The strip-like edges of the ground contact plate, which protrude on both sides of the planar filter, are provided for that purpose with perforations for the leadthrough of the securing prongs of the lateral baffle inserts, and these securing prongs serve the purpose of both fixation and of connection to a common ground.

It is also advantageous if the openings which are provided in the base plate for the leadthroughs of the signal pins have a conical widening toward the recess. This embodiment makes it easier to insert the connection pins (or bushes provided instead of connection pins).

In accordance with another feature of the invention, the side strips of the ground contact plate are provided with a bend along the edge or edges of the planar filter, for the sake of fixation and adaptation to height differences.

In accordance with a concomitant feature of the invention, in addition, or alternatively, the planar filter is provided with a low-height height compensator, in order to compensate for projecting parts of the connection pins of larger diameter. Thus dimensional differences can also be circumvented, which plays an essential role especially in retrofitting.

Other features which are considered as characteristic for the invention are set forth in the appended claims.

Although the invention is illustrated and described herein as embodied in a planar filter for a multi-pole plug connector and a plug connector using the planar filter, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 3 is a fragmentary, perspective view of a separate ground contact plate;

FIG. 4 is a view similar to FIG. 3 of a planar filter with a separate ground contact plate;

FIG. 5 is a perspective view of a contact insert;

FIG. 6 includes a side-elevational and a plan view of a contact insert;

Figure 8:
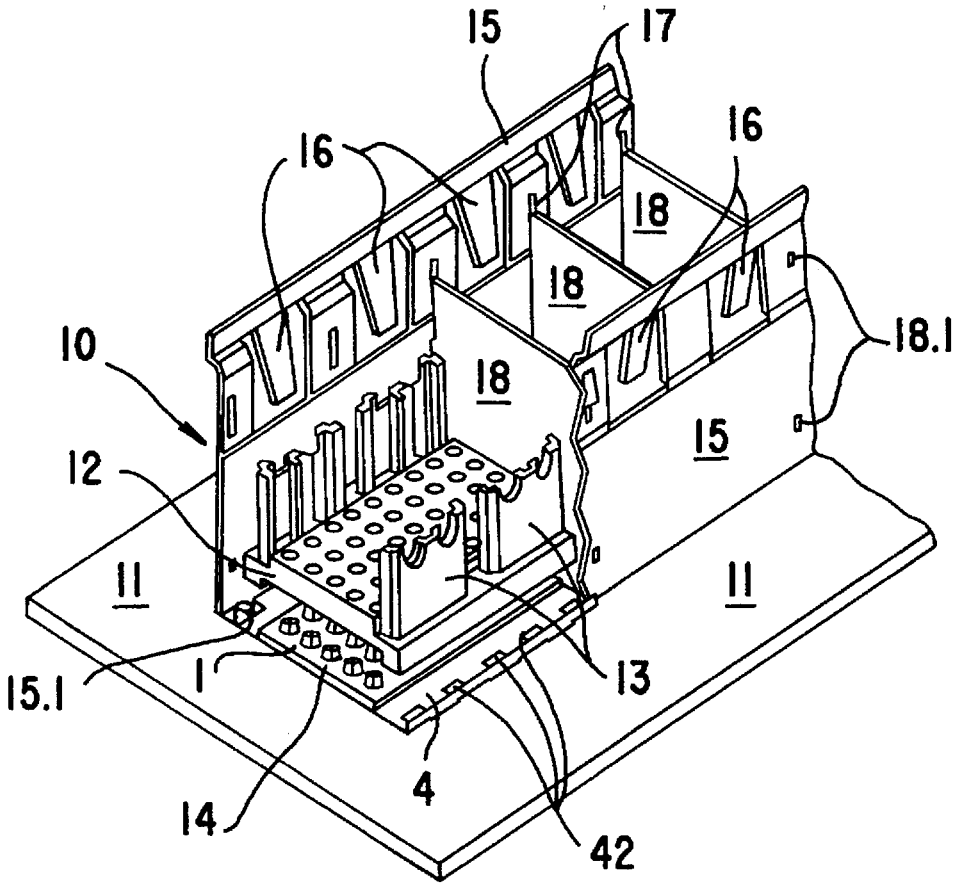

FIG. **7*a*** is an enlarged, fragmentary view of the signal electrode of a capacitor with a double structure, embedded in surrounding capacitors;

FIG. **7*b*** is an enlarged, fragmentary view of the signal electrode of a capacitor with a double-T structure, embedded in surrounding capacitors;

FIG. 8 is a fragmentary, perspective view of an example of a use of a planar filter in a plug connector;

FIG. **9*a* is a sectional view of the plug connector of FIG. 8, in which the planar filter is in a recess; and FIG. 9*b* is a view similar to FIG. 9*a*** in which the planar filter is inserted retroactively.

DESCRIPTION OF THE PREFERRED EMBODIMENTS

Figure 1:
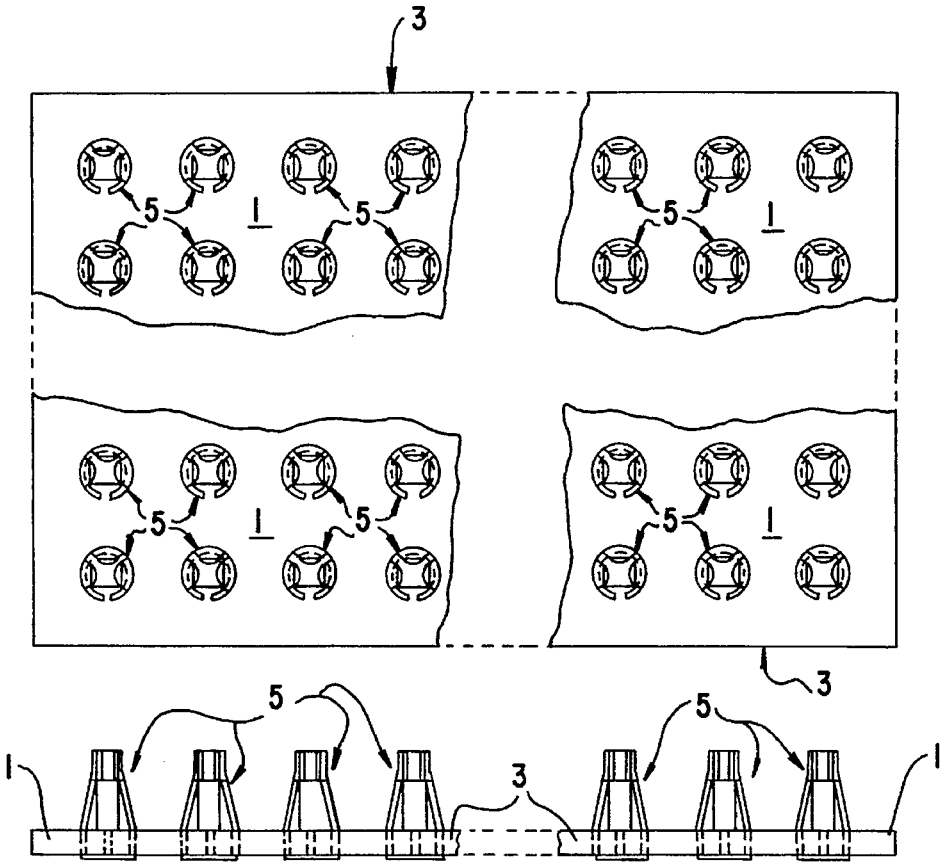
FIG. 1 includes fragmentary, diagrammatic, top-plan and side-elevational views of a planar filter with contact inserts.
Figure 2:
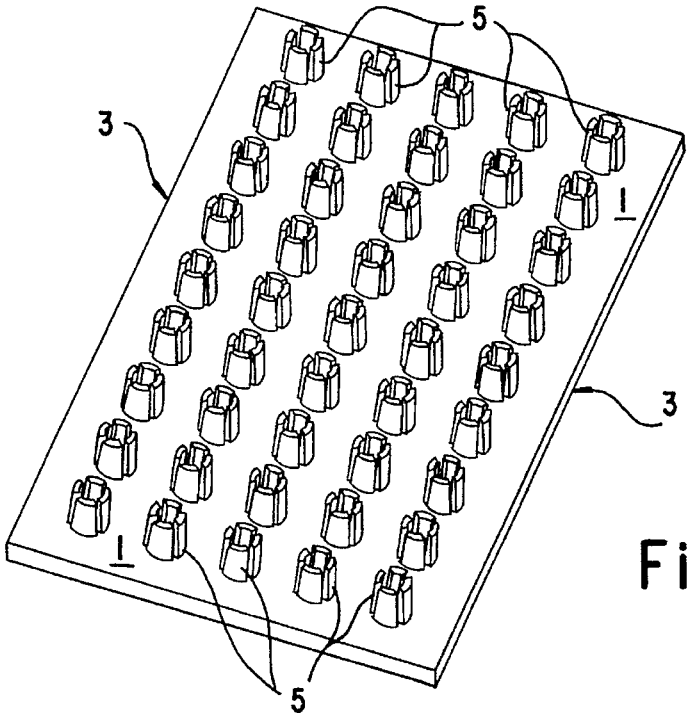
FIG. 2 is a perspective view of a planar filter with contact inserts.

Referring now to the figures of the drawing in detail and first, particularly, to FIGS. 1 and 2 thereof, there is seen a plan view, a side view and a perspective view of a planar filter 1 with rows and columns of leadthrough openings for connection pins 11.1 which are shown in FIGS. 9*a* and 9*b*. Interruptions that are seen in the illustration of the planar filter in FIG. 1 and are suggested in both dimensions, are an indication that in principle it can be used for an arbitrary number of signal connections. For each of the signal line leadthroughs, the planar filter includes at least one capacitor with two coatings, one of which is connected to the associated signal line and the other of which is connected in general to ground, as a common electrode for all of the capacitors or for groups of the capacitors. With this embodiment, this planar filter 1 is suitable for use as a filter for a number of signal lines, which by way of example are intended to make a connection from connection contacts of a printed wiring board 11 which is seen in FIG. 8 and is provided with the connection pins 11.1 that are seen in FIGS. 9*a* and 9*b*, to further electronic components through a plug connector 10 seen in FIG. 8. Contact inserts 5 are inserted into the leadthrough openings and are constructed in such a way that the connection pins 11.1 seen in FIGS. 9*a* and 9*b* that carry the electronic signals are fixed in the leadthrough openings of the planar filter 1 and, in order to make an electric connection, are connected to the capacitor, associated with the connection pin, of the planar filter 1. For this purpose, the coating that forms the signal electrode is extended all the way into the leadthrough opening in a known manner. The counterpart coatings of the capacitors of the planar filter 1 are all connected in common or in groups and are advantageously extended out to two opposed metallized lateral surfaces 3 and connected to the general ground through contact-making means. It will be understood that the ground electrode may also be extended to all four sides of the planar filter 1, and a self-induction, which is dictated by the geometry of the planar filter and which under some circumstances may be interfering, determines the course of the ground contacts. However, it is advantageous for the ground to be extended over the contact surfaces 3 of the planar filter 1 around to its back side, in order to achieve shielding on the back. It is self-evident that the back is provided with capacitors, for instance to attain parallel circuits for higher capacitances or series circuits for higher voltage proofness.

FIGS. 3 and 4 show a separate ground contact plate 4 along with a planar filter 1 that is provided with such a ground contact plate 4, and has openings for the leadthrough of the connection pins in which the contact inserts 5 are inserted. For each connection pin 11.1 seen in FIGS. 9*a* and 9*b* to be led through, the ground contact plate 4 has one opening 4.1, having a diameter which is adequate to prevent any contact between the connection pin and the ground contact plate 4 that is at ground potential. Laterally protruding strips of the ground contact plate 4 are provided in this case with a bend 4.3, and moreover they have slit-like openings 4.2, through which securing prongs 15.1 seen in FIG. 8 of lateral shields 15 also seen in FIG. 8, can be guided and clamped for the sake of securing and making contact. The planar filter 1 is placed on the ground contact plate 4 in such a way that axes of the openings 4.1 for the connection pin leadthroughs are aligned with the contact inserts 5 that are inserted into the openings of the planar filter 1 for the leadthrough of the connection pins 11.1 seen in FIGS. 9*a* and 9*b*.

FIGS. 5 and 6 show details of the contact inserts. The perspective view of FIG. 5 illustrates the formation of the contact inserts 5. Sheaths 6, which are intended for approximately form-locking insertion into the openings for the leadthrough of the connection pins 11.1 seen in FIGS. 9*a* and 9*b* in the planar filter 1, are constructed as soldering sheaths. In order to provide for better form-locking upon insertion, the sheaths each have a slit or axial gap 6.1, which can also yield resiliently and thus facilitate the insertion. FIG. 6 shows this construction in a plan view and a side view.

Figure 7:
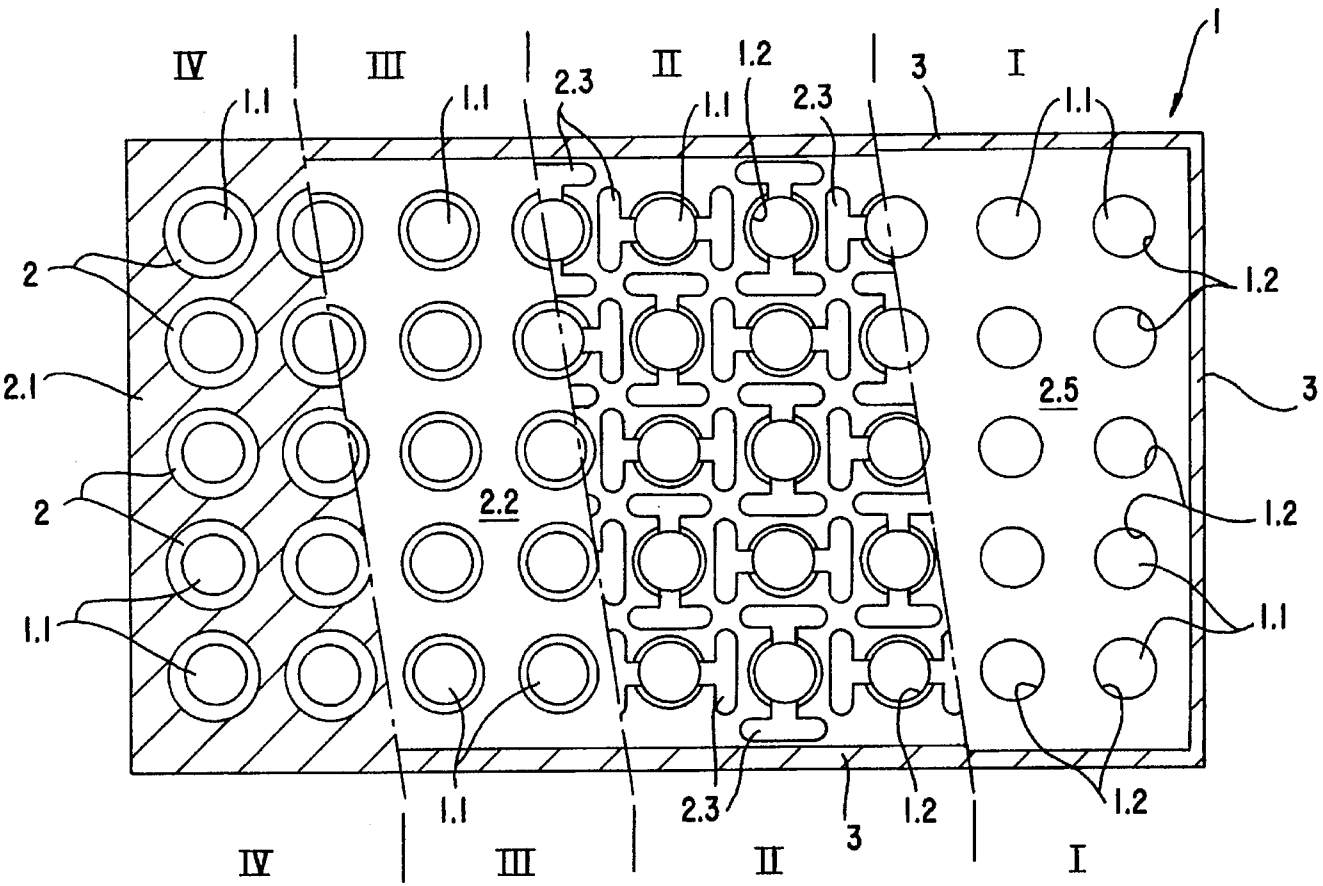
FIG. 7 is a partly broken-away plan view illustrating a formation of a signal electrode of capacitors.

FIG. 7 shows a planar filter 1, with its layered structure being cut away from right to left. A covering can be seen in a right-hand segment I; signal electrodes can be seen in a next segment II to the left; a dielectric can be seen in a next segment III; and finally a continuously constructed ground electrode can be seen in a segment IV. The planar filter 1 is built up in layered fashion from a substrate 2 on which a ground electrode 2.1 is disposed under the entire surface except for recessing of an annular space around leadthrough openings 1.1 for the connection pins 11.1 seen in FIGS. 8, 9*a* and 9*b*, and on which a dielectric 2.2 is applied in such a way that it covers the ground electrode 2.1 in the regions of the leadthrough openings 1.1, while the ground electrode 2.1 is exposed in the regions of the metallized edges 3 and permits connection to a general ground. Signal electrodes 2.3 are applied in pairs onto the dielectric 2.2 on either side of each leadthrough opening 1.1 and are disposed in such a way that arms 2.4 thereof, seen in FIGS. 7*a* and 7*b*, extending in the direction of the preferential axis, are connected to a metallizing 1.2 in the leadthrough opening 1.1. The planar filter 1 is protected against external influence by a covering 2.5, which ensures that the contact surfaces on the edges 3 of the planar filter 1, which form the ground connection, remain exposed. These structures are advantageously produced by means of known screenprinting processes, since it is thus possible to achieve the necessary fineness at commercially reasonable expense.

Figure 7A:
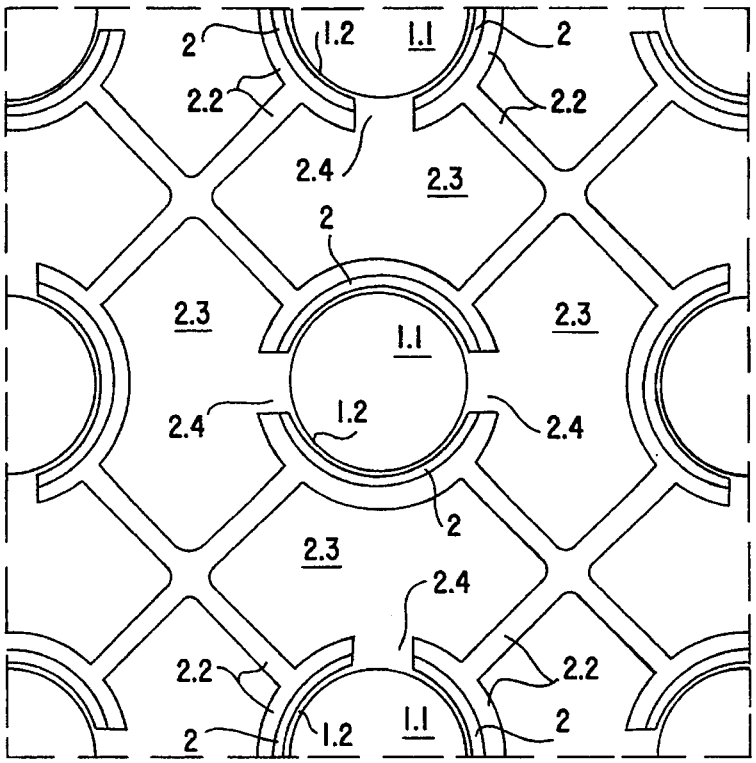
Figure 7B:
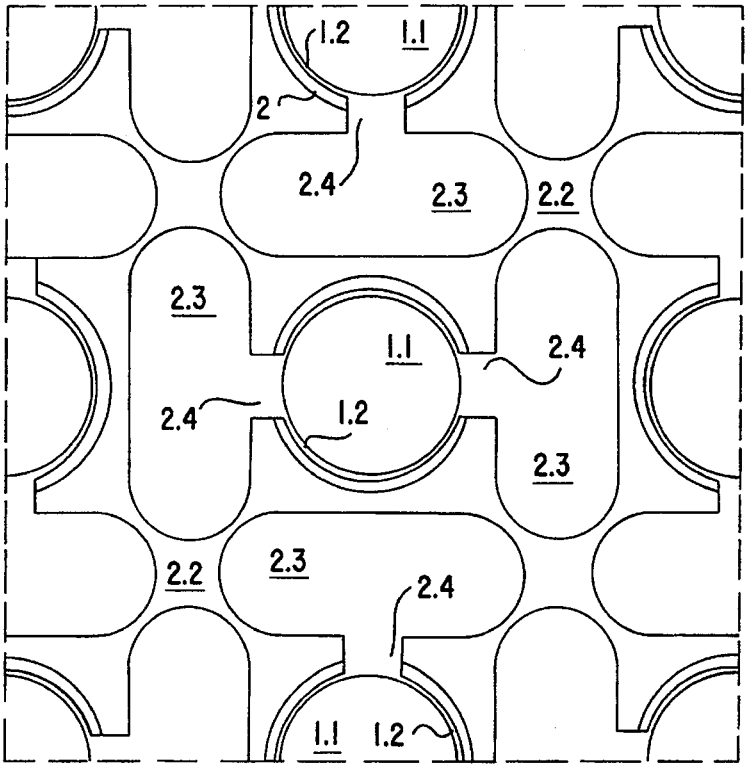

The signal electrodes 2.3, which are shown as highly enlarged fragmentary views in two different forms in FIGS. 7*a* and 7*b*, form double structures with a preferential axis, which are somewhat similar in shape to a dumbbell or a diabolo. FIG. 7*a* shows one such embodiment, which fills up a virtually maximum surface area, taking into account annular regions around the connection pin leadthroughs 1.1, in which regions the ground electrodes 2.1 seen in FIG. 7 that are covered by the dielectric 2.2 are recessed and in which regions the substrate 2 is partly exposed, and taking into account the requisite spacing for insulation purposes because of different potentials between the various signal electrodes 2.3 (this spacing is shown only in the middle region). The surfaces of the two electrodes 2.3, which in this case are constructed in an approximately leaf shape, are connected by their arms 2.4 that extend in the direction of the preferential axis, to the metallizings 1.2 of the connection pin leadthroughs 1.1, in order to establish the electrical connection with the connection pin 11.1 seen in FIGS. 8, 9*a* and 9*b*. Located under the dielectric 2.2 which is seen in FIG. 7 and is covered by them is the continuous ground electrode 2.1, except for a portion of the arm 2.4, so that (virtually) the entire surface area contributes to forming the capacitance.

FIG. 7*b* shows a modification of this structure, in which the signal electrode 2.3 (shown only in the middle region), that is likewise shown on an enlarged scale in this case, of a capacitor in the region around adjacent capacitors, has the structure of a double T, which includes the leadthrough opening 1.1 in the center for the associated connection pin. The parts of the structure that correspond to the flanges of a double T profile form the signal electrodes 2.3, which are connected to the metallizing 1.2 in the leadthrough opening 1.1 through the arms 2.4 that extend in the direction of the preferential axis. Together with the ground electrode 2.1 which is seen in FIG. 7 and is separated by the dielectric, they form the respective capacitor and determine its capacitance. Regardless of the embodiment of the surface structures forming the majority of the capacitor, the arms 2.4 of the structure that extend in the directional of the preferential axis are extended as far as the metallizing of the leadthrough opening 1.1 for the associated connection pin and are connected to it through the metallizing 1.2 extending into this opening. In order to make the contact between the signal electrode and the connection pin, the contact insert 5 is soldered into the connection pin leadthrough 1.1 into which the connection pin 11.1 (see FIGS. 8, 9*a* and 9*b*) is introduced. The pin is clamped by contact prongs 7 that are seen in FIGS. 5 and 6 of the contact insert 5 and is thus both mechanically fixed and electrically connected. This clamping is not a rigid fixation, so that due to this type of fastening, the planar filter 1 is kept free of mechanical strains. When the connection pins are flat connectors, two contact prongs 7 seen in FIG. 5 cooperate with the flat connectors and are disposed opposite one another, for clamping the flat connectors. When the connection pins are signal pins in the form of round connectors, three contact prongs cooperate with the signal pins, and the contact prongs of each of the contact inserts are disposed at an angular spacing of 120° or 90° from one another relative to a circumferential angle of the sheath, for clamping the signal pins.

FIG. 8 shows one possible example of use of the plug connector 10 which is mounted on the printed wiring board 11. The connection pins 11.1 seen in FIGS. 9*a* and 9*b*, which are fixed approximately by a press fit connection in the printed wiring board 11, are connected there to corresponding tracks and represent necessary connection locations for use of the printed wiring board, which locations are to be connected with further electronic circuits or switching elements, and the connection should be a disconnectable one. This disconnectability is attained with the plug connector 10, which cooperates with a non-illustrated counterpart connection. This plug connector is constructed with a base plate 12 of plastic, which is provided with a number of non-illustrated leadthrough openings that correspond to the number and configuration of connection pins 11.1. Guide prongs 13 which are formed onto the base plate 12 are provided laterally. The guide prongs 13 engage the counterpart connections that are to be inserted and guide them in such a way that the connection pins 11.1 seen in FIGS. 9*a* and 9*b* meet bushes of the counterpart connector and can be introduced into them. The base plate 12 also has a recess 14 in its lower surface or underside, of such a height that the planar filter finds space. The planar filter is provided with the ground contact plate 4 having the securing slits 4.2, by way of which the ground contact is made either to the printed wiring board 11 or to the counterpart connector. The ground connection extends through the lateral shields 15 and may also be extended from the printed wiring board to the counterpart connector through these shields or vice versa. The securing tongues 15.1 of the lateral shields 15 extend through the slit-like securing openings in the ground contact plate 4 and in the printed wiring board 11 and are fixed accordingly, and at least some of them form contact tongues, in order to achieve more-secure grounding connection with the counterpart connector. The lateral shields 15 also have tabs 16.

Extending between and at right angles to the lateral shields 15 are transverse shields 18, which are guided between the pairs of guide prongs 13 and are retained by contact protrusions 18.1, which protrude through non-illustrated slits in the lateral shields. The base plate 12 also advantageously has slit-like openings between the compartments, which are separated from one another by the transverse shields 18, of the plug connector 10, that are also provided on the ends so as to act as a boundary to the plug connector 10. The unavoidable projections of the contact prongs 7 of the contact inserts 5 protrude beyond the surface of the planar filter 1 (as is seen in FIGS. 1 and 2). In order to enable these projections to be received, the openings for the leadthrough of the connection pins 11.1 that are provided in the base plate 12 are recessed from the recess 14 in such a way that these cone-shaped projections can be received by these recesses in the substrate of the planar filter 1.

FIGS. 9*a* and 9*b* each show a section through a plug connector of FIG. 8. The base plate 12 is secured to the printed wiring board 11, and the connection pins 11.1 are at right angles to the printed wiring board 11 and are extended through the base plate 12 of the plug connector 10. The lateral shields 15, a lateral shield 15' on the end surface, and the transverse shields 18 form a housing of the plug connector 10. In FIG. 9*a*, it is seen that the base plate 12 is provided with the recess 14, so that the planar filter 1 is accommodated in this recess. The projections of the contact prongs 7 are located in a cone-shaped recess 12.1 of the base plate 12. A base plate 12' shown in FIG. 9*b* is equivalent to the prior art and it has no recess for insertion of the planar filter 1. In this case the planar filter 1 has been retroactively mounted with the contact inserts 5 and is located on the side of the base plate 12' opposite the counterpart connector. With this type of insertion of the thus-equipped planar filter, retrofitting can accordingly be performed in a simple way.

I claim:

1. In a plug connector having a conducting metal housing and a plurality of signal lines in the form of connection pins disposed in rows and columns, a planar filter assembly comprising: a planar filter having a ground electrode and two opposed edges constructed as conductive side regions being connected to said ground electrode and being connected to ground through the housing;

a substrate having openings formed therein each receiving a respective one of the connection pins;

capacitors each being disposed in the vicinity of a respective one of said openings for a respective one of the connection pins, each of said capacitors having a first coating being connected to a respective one of the connection pins and being extended into a respective one of said openings, a second coating connected through said housing to ground, and a layer-like dielectric disposed between said first and second coatings;

contact inserts each being soldered in a respective one of said openings for retaining a respective one of the connection pins and each having at least one contact prong electrically connecting a respective one of the connection pins to said first coating of a respective one of said capacitors;

wherein said openings are leadthrough openings having metallizings disposed therein, said first coatings of said capacitors are associated with signal electrodes on said substrate in the form of double structures with a preferential axis in the shape of a dumbbell or a diabolo, a middle and connecting arms, said preferential axes of said double structures of said coatings of adjacent capacitors cross one another, and said connecting arms of said two partial structures encompass said leadthrough openings for the connection pins in said middle and are connected to said metallizings.

2. The planar filter assembly according to claim 1, wherein said double structures are double T structures.

3. The planar filter assembly according to claim 1, wherein each of said contact inserts has a soldering sheath inserted into a respective one of said leadthrough openings for the connection pins, and each of said sheaths is soldered and electrically connected to a respective one of said first coatings being associated with said signal electrode and extending into a respective one of said openings.

4. The planar filter assembly according to claim 3, wherein said at least one contact prong are at least two contact prongs, and wherein the connection pins are flat connectors, said at least two contact prongs of each of said contact inserts are two contact prongs cooperating with a respective one of the flat connectors and being disposed opposite one another, for clamping the flat connectors.

5. The planar filter assembly according to claim 4, wherein said sheaths each have an axial gap centrally disposed between said two contact prongs.

6. The planar filter assembly according to claim 4, wherein the connection pins are signal pins constructed as round connectors, said at least two contact prongs of each of said contact inserts are three contact prongs cooperating with a respective one of the signal pins, and said contact prongs of each of said contact inserts are disposed at an angular spacing of 120° or 90° from one another relative to a circumferential angle of said sheath, for clamping the signal pins.

7. The planar filter assembly according to claim 6, wherein said sheaths each have an axial gap centrally disposed between two of said contact prongs.

8. The planar filter assembly according to claim 7, wherein said contact prongs are clamping arms, said sheaths each have an axial gap centrally disposed between two of said clamping arms, two of said clamping arms are mutually adjacent and have an angular spacing of 90° from said gap, and the third of said clamping arms is disposed diametrically opposite said gap.

9. In a plug connector having a conducting metal housing and a plurality of signal lines in the form of connection pins disposed in rows and columns, a planar filter assembly comprising:

a planar filter having a ground electrode and two opposed edges constructed as conductive side regions being connected to said ground electrode and being connected to ground through the housing;

a substrate having openings formed therein each receiving a respective one of the connection pins;

capacitors each being disposed in the vicinity of a respective one of said openings for a respective one of the connection pins, each of said capacitors having a first coating being connected to a respective one of the connection pins and being extended into a respective one of said openings, a second coating connected through said housing to ground, and a layer-like dielectric disposed between said first and second coatings;

contact inserts each being soldered in a respective one of said openings for retaining a respective one of the connection pins and each having at least one contact prong electrically connecting a respective one of the connection pins to said first coating of a respective one of said capacitors;

wherein said openings are leadthrough openings each having a given diameter, and including a metal ground contact plate to which said planar filter is fixed and conductively connected, said ground contact plate having openings formed therein corresponding to said leadthrough openings for the connection pins and having diameters being larger than said given diameters for avoiding short circuits between the connection pins and ground, and said ground contact plate having a strip-shaped projection on one side of said planar filter for connection to contacts to be connected to ground.

10. The planar filter assembly according to claim 9, wherein said planar filter has metallized side regions, said strip-shaped projection connects said metallized side regions to ground, and the plug connector has a mass connection.

11. The planar filter assembly according to claim 9, wherein said ground contact plate has another strip-shaped projection disposed on another side of said planar filter opposite said one side.

12. The planar filter assembly according to claim 9, wherein the plug connector has lateral shields with baffles having securing prongs, and said strip-shaped projection of said ground contact plate has openings formed therein for leading the securing prongs through.

13. A plug connector to be mounted on a printing wiring board, comprising:

signal lines in the form of connection pins;

a planar filter having a substrate with openings formed therein each receiving a respective one of the connection pins, said planar filter having capacitors, and said planar filter having contact inserts clamping and making contact with said connection pins;

lateral shielding baffles having securing and contact prongs;

a plastic base plate having a side facing toward a printed wiring board, said side having a recess formed therein receiving said planar filter, said base plate having openings formed therein widening conically toward said recess for leading the connection pins through, and said base plate having openings formed therein for leading said securing and contact prongs through for connecting said securing and contact prongs to general ground;

lateral guide prongs extending at right angles to said base plate and being formed onto said base plate for engaging and guiding counterpart plugs, with said connection pins meeting and being introduced into bushes, said lateral guide prongs being disposed in segments having interruptions therebetween;

transverse shields being inserted in said interruptions between at least some of said segments; and a ground contact plate to which said planar filter is fixed and conductively connected, said ground contact plate having strip-like projections clamping and making contact with said securing and contact prongs of said lateral shielding baffles for electrically connecting said planar filter through to said connection pins and to ground with said capacitors acting as capacitances between said connection pins and ground; and wherein said planar filter has edges, and said strip-like projections of said ground contact plate are lateral strips having at least one bend alone at least one of said edges of said planar filter, said bend allowing adaptation to height differences.

14. The plug connector according to claim 13, wherein said planar filter has a low-height height compensator to compensate for projecting parts of said connection pins having a larger diameter.

* * * * *